United States Patent [19]

Cucheran

[11] 4,373,277

[45] Feb. 15, 1983

[54] CUTTER EXTENSION CONE

[76] Inventor: Edward Cucheran, 23 Dunbar Crescent, Winnipeg, Canada

[21] Appl. No.: 328,136

[22] Filed: Dec. 7, 1981

[51] Int. Cl.[3] ..... E02F 3/92
[52] U.S. Cl. ..... 37/67
[58] Field of Search ..... 37/67, 65, 64

[56] References Cited

U.S. PATENT DOCUMENTS

| | | | |
|---|---|---|---|
| 2,242,520 | 5/1941 | Grundborg | 37/67 |
| 3,253,357 | 5/1966 | Allard | 37/65 |
| 3,495,409 | 2/1970 | Riedemann | 37/67 X |

FOREIGN PATENT DOCUMENTS

| | | | |
|---|---|---|---|
| 2030240 | 10/1979 | Fed. Rep. of Germany | 37/65 |
| 298911 | 8/1965 | Netherlands | 37/67 |
| 7108107 | 12/1972 | Netherlands | 37/67 |
| 1120538 | 7/1968 | United Kingdom | 37/67 |
| 436134 | 1/1975 | U.S.S.R. | 37/67 |
| 757647 | 8/1980 | U.S.S.R. | 37/67 |

*Primary Examiner*—Clifford D. Crowder
*Attorney, Agent, or Firm*—John T. Roberts

[57] ABSTRACT

An extension cone for a cutter for a hydraulic dredge. The cone has spiral helical blades with an opposing helix to the cutter head to force the material forward as the cutter rotates, thus smoothing the bottom and returning any material which was cut and has passed the cutter head back to the suction orifice.

2 Claims, 6 Drawing Figures

CUTTER EXTENSION CONE

CROSS-REFERENCE TO RELATED APPLICATION

This invention is not disclosed in any co-pending application for patent or any issued patent.

SUMMARY OF THE INVENTION

This invention is an improvement in hydraulic dredges used to clear channels in rivers and shorelines and in underwater mining. This invention may be used with the standard cutter dredge and any of the well-known variety of cutters or cutter heads.

A hydraulic or cutter dredge is normally employed to cut a channel of a certain width and depth. With the current price of fuel, the hourly operating cost is substantial and therefore the operating efficiency of these dredges is very important.

This invention is particularly useful for dredges operating in soft bottom material such as mud or silt which is easily displaced. The conventional cutter may have to make several passes to remove all of the material since it will slide around and behind the cutter during the first pass of the cutter head.

While the cutter is being returned for a second pass, or while the dredge is being backed up, the dredge is pumping mostly water, which pumping costs nearly as much as the mud or silt but accomplishes very little. This invention substantially reduces this expensive dead time.

It is an object of this invention to modify the standard cutter to permit increased productivity, particularly in soft material dredging.

It is a further object to permit more accurate cutting of a channel in producing a smoother cut at the prescribed dredging depth and within the required dredging tolerance.

It is a further object to provide for sweeping material behind the suction orifice back to the orifice while cutting material in front of the orifice and forcing it backwards into the suction orifice.

BRIEF DESCRIPTION OF THE DRAWINGS

The invention will be described with reference to the annexed drawings in which.

DESCRIPTION OF THE PREFERRED EMBODIMENT

Figure 1:
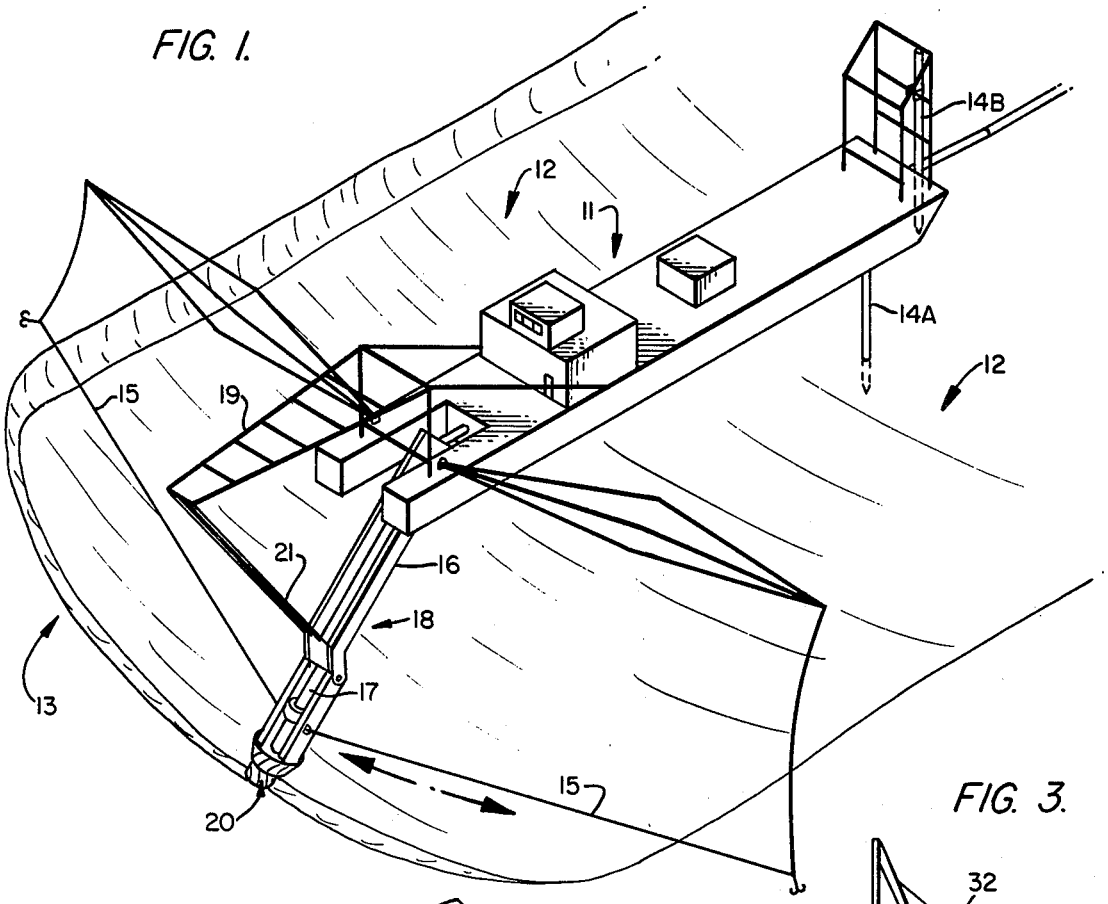
FIG. 1 is a diagrammatic perspective view of a hydraulic dredger employing the cutter extension cone.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As is shown in FIG. 1, a conventional hydraulic dredge 11 is shown cutting a channel 12 in an underwater bank 13.

The dredge pivots on submerged spud 14A and is pulled from side to side by anchor lines 15. The barge is walked forward by sinking the second spud 14B. The ladder or beam 16 carries the drive shaft 17, suction line 18 and cutter 20. The ladder is pivoted on the hull allowing the depth of the cutter to be controlled by a conventional block and tackle 21 which is attached to bow gantry 19.

The end of the ladder may optionally have a known second pivot 22, controlled by hydraulic or other means 23 to provide more rapid and precise adjustment to the cutter position. A second advantage of this auxiliary pivot is that it allows the lower surface of the cutter extension cone to be horizontal, whatever the depth of the cutter.

The drive shaft is axial and passes through a fixed circular ring 24 to connect to the cutter. There are a number of conventional cutter designs, some with spiral helical blades 25 and serrations or teeth 26. As shown, the blades spiral forward clockwise when viewed from the front. The cutter turns clockwise, thus cutting into the material of the bank and forcing it toward the rear.

The ring 24 contains a generally elliptical aperture 27 which forms the open end of the suction pipe 18.

Figure 3:
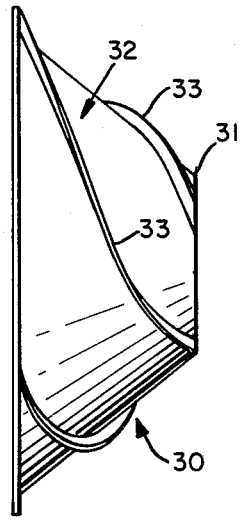
FIG. 3 is a side view of the cutter extension cone.
Figure 2:
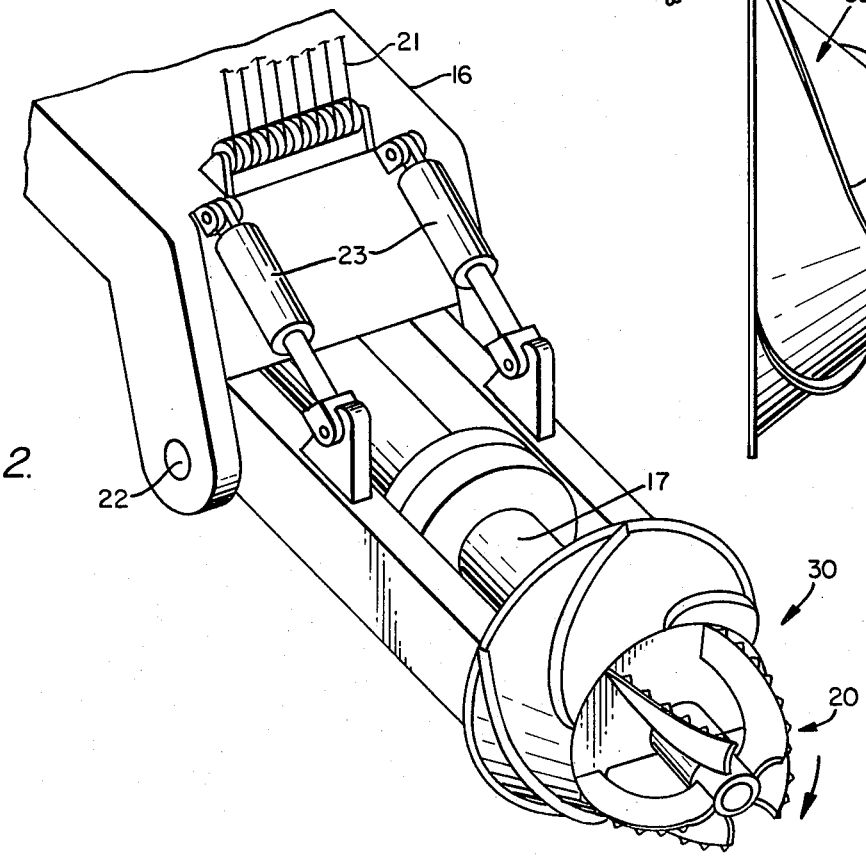
FIG. 2 is an enlarged view of the end of the beam or ladder including the cutter and cutter extension cone.

The cutter extension cone 30 of this invention is not a mere extension of the cutter 10 as the name might imply. Rather it is in some ways just the opposite. The cone attaches at its front 31 to the back of the cutter 20. The cone surface 32 extends outwardly and backwardly. The particular dimensions form no part of the invention and those illustrated in FIG. 3 are exemplary only.

Generally the angle between the cone surface 32 and the axis will approximate the angle between the drive shaft itself and the bottom when the cone is in its operating position. This allows the bottom portion of the cone to be approximately horizontally on the surface of the channel being cut. Actually the surface does not lie horizontally as the cone rotates with the cutter head.

On the surface of cone 30 are a series of generally spiral helical blades 33. The number and dimensions are not critical to the invention although they will normally approximately equal, in number and depth, the spiral helical blades of the cutter head. Likewise the spiral helix need not be precisely geometrical. What is critical to the invention is the direction of the cone helix. The cone helix direction is opposite to the cutter helix direction.

As shown in FIGS. 2, 4, 5 and 6, the direction of rotation of the drive shaft, the cutter and the cutter extension cone, is clockwise, viewed from the front. The spiral helical blades 25 of the cutter have a forward spiral in the clockwise direction. The spiral helical blades 33 of the cutter extension cone have a forward spiral in the counterclockwise direction . While the helixes can go in either direction, they must be opposite on the particular cutter and the matching cutter extension cone.

By way of illustration only, a cutter extension cone for a cutter with an eight (8) foot diameter could have the following dimensions. Front diameter eight (8) feet, cone length along axis five (5) feet, diameter at rear of cone fifteen (15) feet.

In operation the cutter cuts the material and sweeps it back to the suction orifice. At high levels of lateral movement in soft material, not all of the material makes it through the orifice in the first pass. Substantial amounts flow back on either side of the cutter. This is particularly true when a cave-in or collapse of the wall has occurred. If the material slides back further than the length of the cutter, the blades cannot pick the material up without stepping the entire dredge to the rear. This is time consuming and expensive.

The cutter extension cone rests on the bottom and its spiral helical blades force material forward as the cutter and cone rotate. Due to its greater diameter at the rear it will catch material thrown back by the cutter and will return it to the suction orifice.

Figure 4:
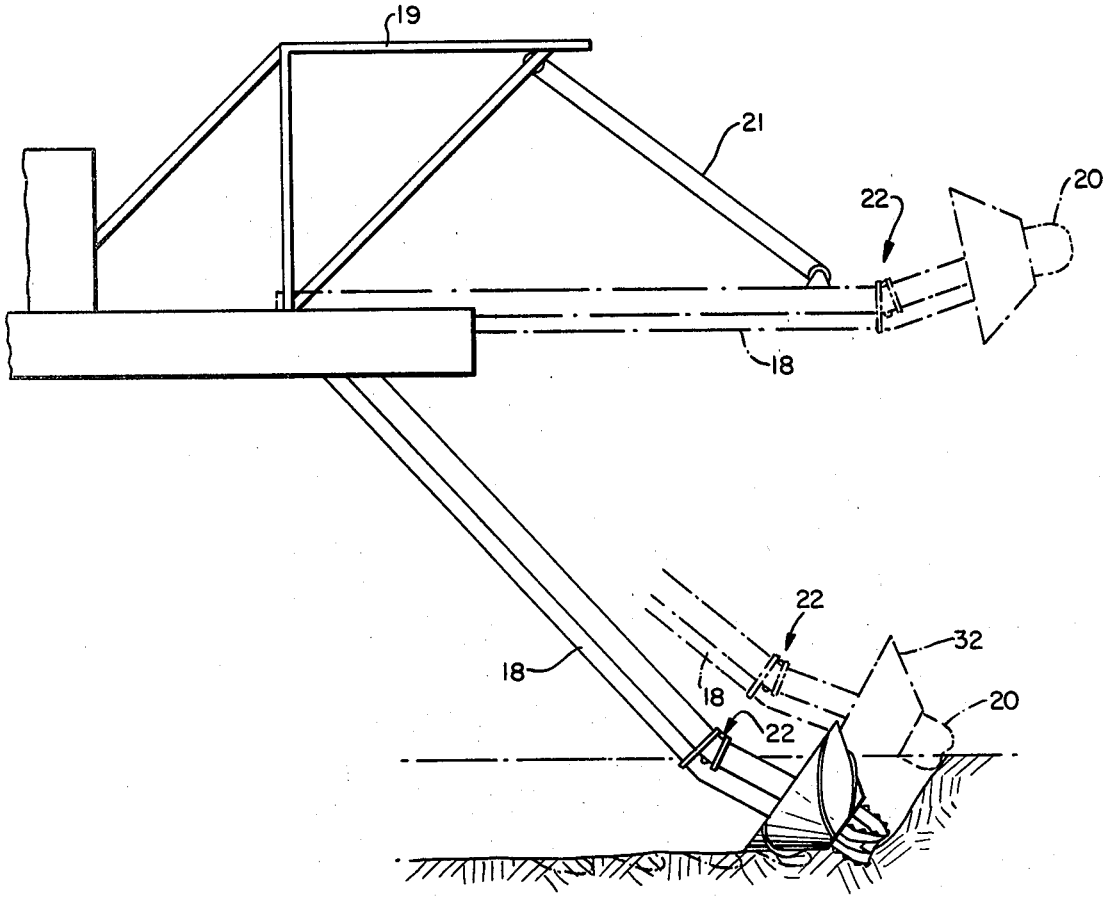
FIG. 4 is a partial side view showing the ladder, in raised and lowered positions, with the cutter and cutter extension cone.
Figure 5:
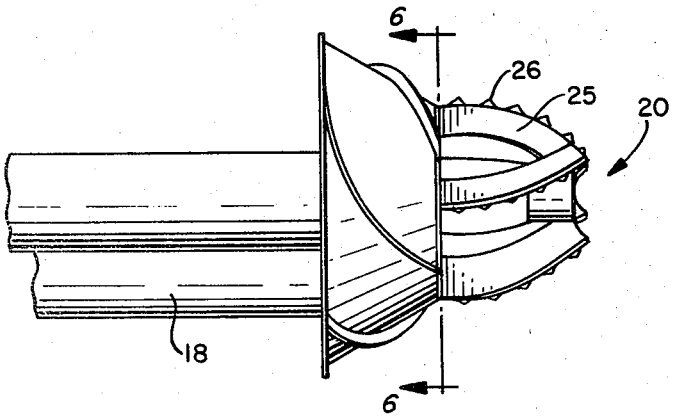
FIG. 5 is a detailed side view of the end of the ladder showing the cutter and cutter extension cone and the spiral helical blades of both, one wound clockwise and the other wound counterclockwise.
Figure 6:
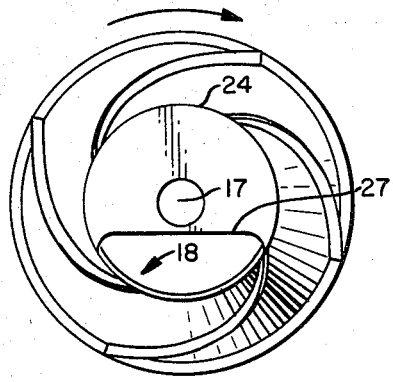
FIG. 6 is a front section taken on lines 6—6 of FIG. 5.

The cutter extension cone provides a greater surface resting on the bottom and can also therefore eliminate the ridges formed by incremental sweeps of the cutter head as is shown in FIG. 4. This means that the average depth of the cut may be the target depth, rather than forcing the operator to ensure that the minimum depth, the peaks between the troughs, is the target depth. Thus less material need be dredged to ensure a channel of a given depth.

Although the present invention has been described with reference to a particular embodiment thereof, it should be understood that those skilled in the art may make many other modifications and embodiments thereof which will fall within the spirit and scope of the principles of this invention.

What is claimed as new and desired to be secured by patent of the United States is:

1. A cutter extension cone for attachment to a cutter of a hydraulic dredge, said cutter having blades forcing material toward a suction orifice, comprising:

(a) a generally circular front section adapted to attach to the rear section of a cutter;

(b) a generally conical section extending rearwardly from said front section, said section having a conical surface, said one increasing in diameter toward the rear.

(c) a series of generally spiral helical blades along the surface of the cone extending from the front to the rear of the said cutter extension cone;

(d) said spiral helical blades on said cutter extension cone having a from front to rear in spiral direction the direction of rotation;

(e) said cutter extension cone attached to and rotating with said cutter as a unit whereby said cutter extension cone smooths the bottom and forces material forward the suction orifice.

2. An improved hydraulic dredge comprising in combination:

(a) a ladder pivoted at its first end at the bow of said dredge for vertical movement of the end of the ladder;

(b) said ladder carrying a drive shaft and a suction pipe;

(c) a second pivot point near the second end of said ladder, said second pivot point also providing for vertical movement of the second end of the ladder and for an angular adjustment of the axis of the section beyond the second pivot point;

(d) a cutter journaled on the end of the ladder and rotated by said drive shaft;

(e) said cutter having blades;

(f) a cutter extension cone attached at its front to the rear of the cutter and rotating therewith;

(g) said cutter extension cone having a generally conical section extending rearwardly from its front, said section having a conical surface, said cone increasing in diameter toward the rear;

(h) a series of spiral helical blades along the surface of the cone extending from the front to the rear of the said cutter extension cone;

(i) said spiral helical blades on said cutter extension cone having a spiral direction from front to rear in the direction of rotation;

(j) said cutter extension cone attached to and rotating with said cutter as a unit whereby said hydraulic dredge cuts the material as said cutter rotates and simultaneously sweeps additional material forward as the horizontal lower surface of the cone sweeps the bottom behind the cutter.

* * * * *

UNITED STATES PATENT AND TRADEMARK OFFICE

CERTIFICATE OF CORRECTION

PATENT NO. : 4,373,277

DATED : February 15, 1983

INVENTOR(S) : Edward Cucheran

It is certified that error appears in the above-identified patent and that said Letters Patent is hereby corrected as shown below:

Column 4, line 1, "cal surface, said one increasing in diameter" should read --cal surface, said cone increasing in diameter--.

Column 4, line 7, "cone having a from front to rear in" should read --cone having a spiral direction from front to rear in--.

Column 4, line 12, "and forces material forward the suction" should read --and forces material forward toward the suction--.

Signed and Sealed this

Ninth Day of August 1983

[SEAL]

*Attest:*

GERALD J. MOSSINGHOFF

*Attesting Officer*

*Commissioner of Patents and Trademarks*